US006383592B1

(12) United States Patent
Lowry et al.

(10) Patent No.: US 6,383,592 B1
(45) Date of Patent: May 7, 2002

(54) BAG LAMINATE WITH A REMOVABLE STICKER PORTION

(75) Inventors: James W. Lowry; Jeffrey M Schuetz; Krishnaraju Varadarajan, all of Florence, SC (US)

(73) Assignee: Sonoco Development, Inc., Hartsville, SC (US)

( * ) Notice: Subject to any disclaimer, the term of this patent is extended or adjusted under 35 U.S.C. 154(b) by 0 days.

(21) Appl. No.: 09/211,186

(22) Filed: Dec. 14, 1998

(51) Int. Cl.[7] ..... B65D 30/08

(52) U.S. Cl. ..... 428/40.1; 428/41.5; 428/41.6; 428/42.1; 428/42.2; 428/42.3; 428/423.1; 428/424.8; 206/459.5; 383/11; 383/111

(58) Field of Search ..... 428/40.1, 41.5, 428/41.6, 42.1, 42.2, 42.3, 423.1, 424.8; 206/459.5; 383/11, 111

(56) References Cited

U.S. PATENT DOCUMENTS

| | | | | |
|---|---|---|---|---|
| 2,155,057 A | | 4/1939 | Moore | 229/35 |
| 2,186,940 A | | 1/1940 | Sullivan | 40/2 |
| 2,260,064 A | | 10/1941 | Stokes | 93/3 |
| 2,614,349 A | | 10/1952 | Barnes | 40/2 |
| 2,815,620 A | | 12/1957 | Prodigo | 53/14 |
| 2,860,431 A | | 11/1958 | Barnum, Jr. | 40/61 |
| 2,986,325 A | | 5/1961 | Loderhose | 229/68 |
| 3,494,059 A | | 2/1970 | Minasian | 40/306 |
| 3,495,625 A | | 2/1970 | Shuttleworth et al. | 137/637.4 |
| 3,638,340 A | | 2/1972 | Gottschalk | 40/2 |
| 3,822,492 A | | 7/1974 | Crawley | 40/2 |
| 3,925,585 A | | 12/1975 | Aoyagi | 428/42 |
| 4,128,954 A | | 12/1978 | White | 40/310 |
| 4,273,816 A | * | 6/1981 | Tollette | 428/35 |
| 4,281,762 A | | 8/1981 | Hattemer | 206/390 |
| 4,306,367 A | | 12/1981 | Otto | 40/312 |
| 4,345,393 A | | 8/1982 | Price et al. | 40/312 |
| 4,398,985 A | * | 8/1983 | Eagon | 156/233 |
| 4,479,838 A | | 10/1984 | Dunsirn et al. | 156/247 |
| 4,767,654 A | | 8/1988 | Riggsbee | 428/40 |
| 4,895,747 A | | 1/1990 | Birkholz et al. | 428/42 |
| 5,127,743 A | * | 7/1992 | Miller et al. | 383/109 |
| 5,264,265 A | | 11/1993 | Kaufmann | 428/40 |
| 5,653,473 A | | 8/1997 | Laszutko et al. | 283/81 |
| 5,691,015 A | | 11/1997 | Tsukamoto et al. | 428/35.2 |
| 5,704,648 A | | 1/1998 | Brown et al. | 283/81 |

FOREIGN PATENT DOCUMENTS

| | | |
|---|---|---|
| DE | 1 263 474 | 3/1968 |
| DE | 36 20 264 | 12/1987 |
| GB | 6398 | of 1899 |
| GB | 2 084 509 | 4/1982 |
| GB | 2 143 204 | 2/1985 |

* cited by examiner

*Primary Examiner*—William P. Watkins, III
(74) *Attorney, Agent, or Firm*—Drinker Biddle & Reath LLP

(57) ABSTRACT

A film bag is disclosed for containing articles, such as candies, food and other items. The film bag is made from a laminate that includes an inner layer and an outer layer with printed indicia formed on it. The outer layer includes a fixed portion which is attached to the inner layer with a permanent adhesive. The outer layer also includes a removable sticker portion which is substantially coplanar with the fixed portion. The removable sticker portion is attached to the inner layer with a pressure sensitive adhesive. Preferably, at least part of the pressure sensitive adhesive on the removable portion is separated from the permanent adhesive on the fixed portion by a gap.

33 Claims, 2 Drawing Sheets

FIG.1
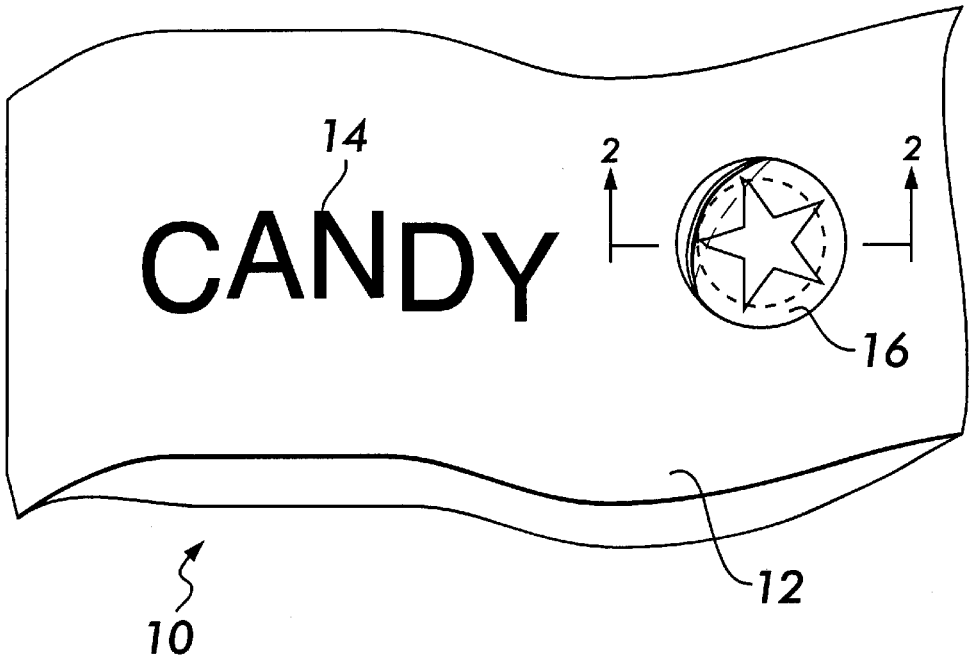
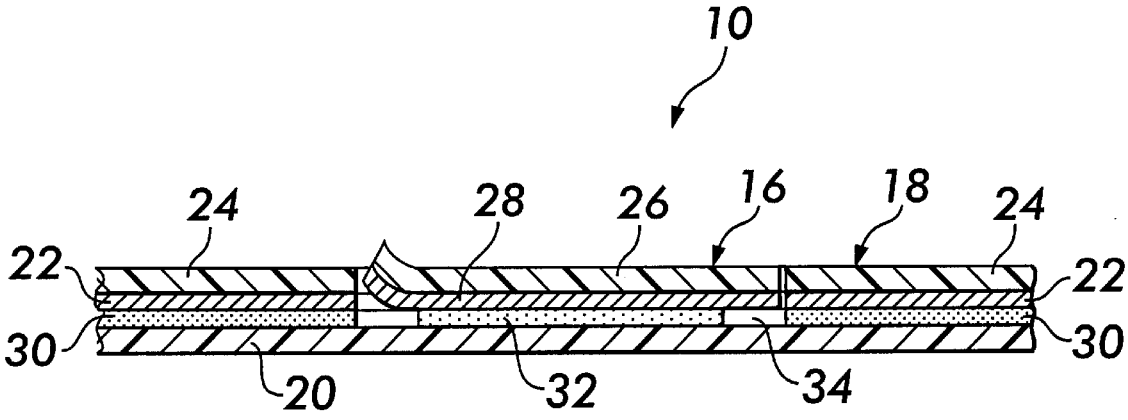
FIG.2

BAG LAMINATE WITH A REMOVABLE STICKER PORTION

FIELD OF THE INVENTION

The present invention relates to a bag for containing items, such as candy. More particularly, the present invention is directed to a bag with a sticker that is formed as part of and removable from the bag.

BACKGROUND OF THE INVENTION

Bags, such as film bags, are utilized extensively in modern society for containing a wide variety of items, such as candies, food items and liquids. A typical film bag is made from a laminate that includes an outer film layer adhesively secured to an inner sealing layer. The outer layer is usually made from a material that facilitates printing. The inner layer is usually made from a material that enables the package to be sealed. Other layers can also be incorporated. Properties, such as permeability to oxygen and moisture, strength, stiffness and other packaging requirements may dictate material selection. The outer and inner layers are both typically made from plastic film, such as polyethylene or polypropylene.

In order to entice a customer to purchase a product, manufacturers typically incorporate promotional advertisements into the product's packaging. For film bags, the promotional advertising has generally been limited to printed indicia on the outer layer of the bag, or ancillary labels that are applied on top of the outer layer.

There have also been attempts over the years to incorporate removable advertising and/or promotional items, such as coupons and stickers, into a product's packaging. The incorporation of a sticker onto packaging is particularly appealing for products directed toward children, such as candy. The stickers tend to entice the children and/or parent to purchase the product in order to subsequently use the sticker. The prior attempts at forming such package configurations all required the incorporation of a release liner or deadening agent into the packaging to prevent the removable items from adhering to the underlying packaging prior to removal. For example, U.S. Pat. No. 4,345,393 to Price et al. discloses a package laminate that includes a removable portion. The removable portion is coated with an adhesive repellant or release agent to facilitate its removal from the laminate.

The primary deficiency with the incorporation of release liners and deadening agents in a package is the cost associated with fabricating the packaging increases since the fabrication process requires additional materials and manufacturing steps.

A need, therefore, exists for an improved film bag which incorporates a removable promotional sticker and is relatively inexpensive to fabricate.

SUMMARY OF THE INVENTION

An object of the invention is to provide a film bag made from a laminate structure which includes a removable sticker portion.

Another object of the present invention is to provide a film bag laminate which includes a means for removing a sticker portion from the remaining portion of the laminate.

These and other objects and advantages are provided by a film bag according to the present invention which is operative for containing articles, such as candies, food and other items. The film bag is made from a laminate that includes a sealing layer and an outer layer. The outer layer preferably has printed indicia formed on it. The outer layer includes a fixed portion which is attached to the sealing layer with a permanent adhesive. The outer layer also includes a removable sticker portion which is substantially coplanar with the fixed portion. The removable sticker portion is attached to the sealing layer with a pressure sensitive adhesive. Preferably, at least part of the pressure sensitive adhesive on the removable portion is separated from the permanent adhesive on the fixed portion by a gap.

In one embodiment of the invention, the gap between the pressure sensitive adhesive and the permanent adhesive completely surrounds the pressure sensitive adhesive.

The foregoing and other features and advantages of the present invention will become more apparent in light of the following detailed description of the preferred embodiments thereof, as illustrated in the accompanying figures. As will be realized, the invention is capable of modifications in various respects, all without departing from the invention. Accordingly, the drawings and the description are to be regarded as illustrative in nature, and not as restrictive.

BRIEF DESCRIPTION OF THE DRAWINGS

For the purpose of illustrating the invention, the drawings show a form of the invention which is presently preferred. However, it should be understood that this invention is not limited to the precise arrangements and instrumentalities shown in the drawings.

FIG. 1 is a perspective view of a film bag with a removable sticker according to the present invention.

FIG. 2 is a cross-section taken along lines 2—2 in FIG. 1 illustrating the novel laminate configuration in the film bag according to the present invention.

DETAILED DESCRIPTION OF THE PREFERRED EMBODIMENTS

Figure 3:
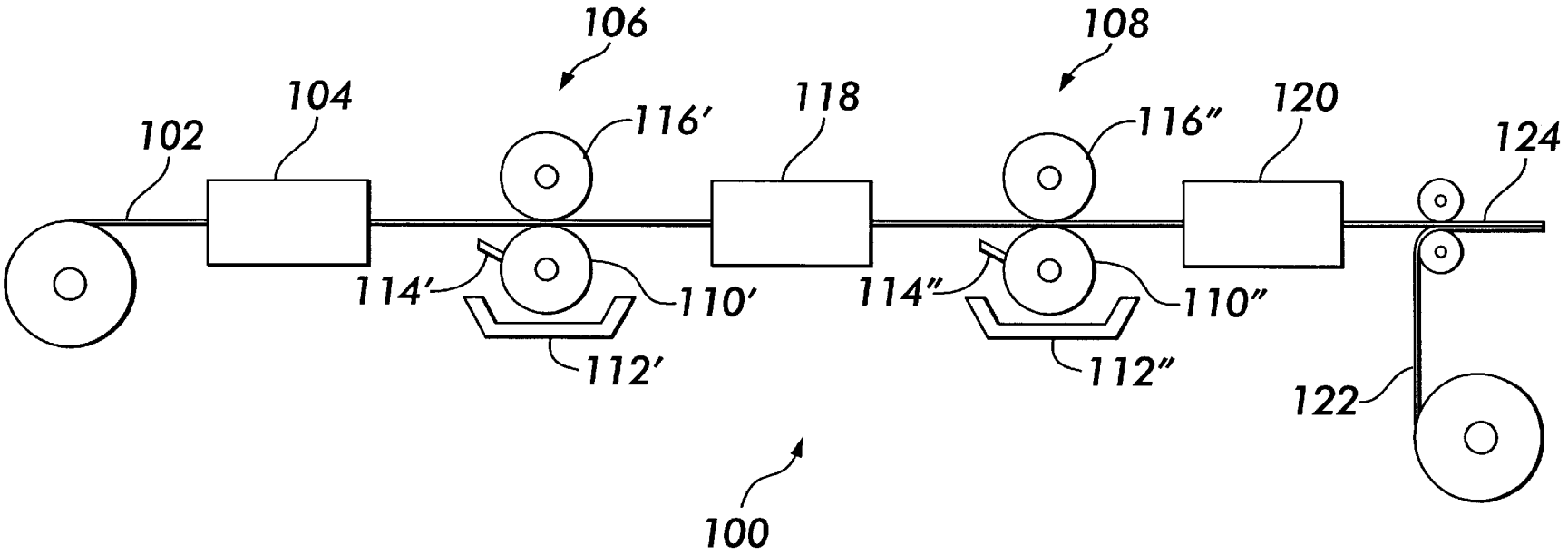
FIG. 3 is a schematic diagram of one preferred method of forming the film bag laminate according to the present invention.

Referring now to the drawings, wherein like reference numerals illustrate corresponding or similar elements throughout the several views, FIG. 1 shows a film bag 10 according to the present invention. The bag 10 is formed from a laminate 12 that includes a series of constituent layers adhesively attached to one another. The film bag 10 is configured to contain one or more products, such as candy or food items. The film bag 10 preferably includes graphical indicia 14, such as pictorial images or text, which may be directed toward the package contents or depict a trademark. The film bag 10 includes at least one peel off or removable sticker 16 that is formed as a part of the film bag 10. Upon removal, the sticker 16 can be adhered to other items, such as a child's shirt or a booklet.

A more detailed understanding of the invention will become apparent with reference to FIG. 2 which shows a cross-section through the laminate 12. The laminate 12 in one preferred embodiment includes an outer layer 18 and a continuous inner or sealing layer 20. The outer layer 18 is preferably made from an oriented polypropylene film having a thickness in a range of about 0.5 mils (13 microns) to about 2.0 mils (50 microns), and more preferably about 0.75 mils (19 microns). One suitable polypropylene film for use in the present invention is sold by Applied Extrusion Technologies, Inc., New Castle, Del. The inner layer 20 is preferably made from polyethylene film having a thickness in a range from about 1 mil. to about 4 mils. There are a wide variety of polyethylene films that would be suitable for use in the present invention.

While the preferred embodiment uses film for forming the laminate, other materials are also contemplated by the present invention, such as foil or paper.

As discussed above, the outer layer 18 preferably includes printed indicia, such as graphics or text. The indicia is formed by one or more layers of printed ink 22 that are preferably disposed on one side of the outer layer 18. As shown in the illustrated embodiment, the ink 22 is preferably deposited on the internally facing side of the outer layer 18. Printing inks for use in film bags and processes for applying such inks are well known in the art and, therefore, no further discussion is needed in this application since a skilled artisan would be readily capable of selecting and applying an appropriate printing ink to the laminate 12.

As shown in FIG. 2, the removable sticker 16 is formed as a portion of the film bag 10. More particularly, the outer layer 16 includes a fixed portion 24 and a removable sticker portion 26. The removable sticker portion 26 is preferably formed from the same material as the fixed portion 24 and substantially coplanar therewith. The removable sticker portion 26 has graphical indicia formed on it by a printed ink layer 28 that is disposed on one side of the removable sticker portion 26. The graphical indicia formed by the printed ink layer 28 on the removable sticker portion 26 may be configured as part of the graphical indicia formed by the printed ink 22 on the fixed portion 24 or may represent a promotional graphic which is made from a distinct printed layer.

The outer layer 18, including the fixed portion 24 and the removable sticker portion 26, is attached to the inner layer 20, preferably by means of an adhesive. In one preferred embodiment, the fixed portion 24 is attached to the inner layer 20 by a permanent adhesive 30, such as a solvent based adhesive. In a further embodiment of the invention, the permanent adhesive is a urethane based adhesive, such as Unoflex Mark III sold by Morton International, Inc. The permanent adhesive 30 is preferably applied at a thickness of about 0.03 to about 0.2 mils. Other methods of fixedly attaching the fixed portion 24 of the outer layer 18 to the inner layer 20 are contemplated by the present invention. A skilled artisan, based on the teachings provided in this specification, would readily appreciate the various alternate means for attaching the fixed portion 24 to the inner layer 20.

The removable sticker portion 26 is attached to the inner layer 20 with a pressure sensitive adhesive 32. The type of pressure sensitive adhesive 32 selected for use in the present invention will vary depending on the desired use for the sticker (e.g., adhering to clothing or paper). Those skilled in the art would readily be capable of selecting a suitable pressure sensitive adhesive 32 in light of the teachings provided herein. In one embodiment of the invention, the pressure sensitive adhesive is a water-based acrylic adhesive, such as Nacor® 72-8761 adhesive, sold by National Starch and Chemical Company, Bridgewater, N.J. The pressure sensitive adhesive 32 is preferably applied to the removable sticker portion 26 with a thickness of about 0.07 to 0.25 mils. The pressure sensitive adhesive 32 is designed to removably affix the removable sticker portion 26 to the inner layer 20. The pressure sensitive adhesive 32 is also selected so as to remain on the removable sticker portion 26 when the removable sticker 16 is detached from the inner layer 20. This permits the sticker 16 to be reapplied to other items, such as a child's shirt.

While the above discussion has described the application of the adhesive to the outer layer 18, it is also contemplated that the adhesive instead be applied to the inner layer 20.

A gap or cutout 34 is formed between the pressure sensitive adhesive 32 and the permanent adhesive 30. This allows the removable sticker portion 26 to be easily separated from the fixed portion 24 of the outer layer 18. In one embodiment of the invention, the gap 34 has a width of about 0.03 inch to about 0.12 inch. The preferred width is about 0.06 inch. Graphical indicia may be included on the outer layer 18 or inner layer 20 providing guidance on where to cut the outer layer 18 so as to separate the fixed portion 24 from the removable sticker portion 26 along the gap 34. Once the outer layer 18 is cut, the sticker 16 can be peeled off the inner layer 20.

It is contemplated that a means for separating the sticker 16 from the outer layer 18 may be provided. For example, the sticker 16 may be die cut from the outer layer 18. Alternately, the outer layer 18 can be scored or perforated around the sticker 16 using a conventional mechanical or laser scoring device. Those skilled in the art are well aware of the various methods and devices that exist for forming a gap in a laminate.

In one preferred embodiment, the gap 34 also separates a section of the removable sticker portion 26 from the fixed portion 24, thus providing a means for separating the sticker 16 from the outer layer 20 by allowing a person to stick the tip of their finger under the removable sticker portion 26 to peel it off the inner layer 20.

In a more preferred embodiment, the gap 34 extends completely around the pressure sensitive adhesive 32 and/or the entire sticker 16 (i.e., removable sticker portion 26, printed ink 28 and the pressure sensitive adhesive 32), thus permitting complete access to the sticker 16.

While the invention has been discussed as including two layers or sheets of film, it is also contemplated that additional sheets of film may be added. Furthermore, the present invention is not limited to the use of a pressure sensitive adhesive under the sticker portion. For example, it is also contemplated that a thermally active adhesive may be applied to the laminate under the sticker portion. The thermally active adhesive is of the type that is activated when exposed to heat, such as by ironing. In this embodiment of the invention, there would be no adhesive holding the sticker to the inner layer. Hence, a complete gap cannot be formed in the outer layer around the sticker since there would be nothing to hold the sticker onto the inner layer. Instead, if a gap is included in the outer layer, the gap must only partially surround the sticker, such as a perforation.

The bag laminate according to the present invention is preferably made in a single forming process 100 as shown in FIG. 3 and discussed hereinafter.

The outer layer of material 102 is fed through a series of printing stations 104 wherein one or more layers of printed ink are applied to the outer layer in any conventional manner known to those skilled in the art.

The outer layer 102 with the printing formed thereon is then fed through first and second adhesive application stations 106, 108. Each adhesive application station includes a rotogravure laminating cylinder 110 that has a copper or similar surface which is capable of being engraved, a pan 112 for applying a suitable liquid to the cylinder 110, and a doctor blade 114 for removing liquid from the non-engraved portions of the cylinder 110. Rotogravure printing processes are well known to those skilled in the art, and are discussed in Package Printing, by Nelson R. Eldred, Ph.D, Jemlar Publishing Co., Inc, Plainview, N.Y., pages 86–88 (1993).

In a preferred embodiment of the present invention, in the first adhesive application station 106, the surface of a first rotogravure cylinder 110' is engraved so as to deliver the appropriate amount and pattern of pressure sensitive adhesive. The first rotogravure cylinder 110' rotates within a pan of pressure sensitive adhesive 112'. As the outer layer 102 passes the cylinder 110', the pressure sensitive adhesive is applied to the layer with a suitable amount of pressure from a roller 116' to force the adhesive to transfer to the outer layer 102. The non-engraved portion of the first rotogravure cylinder 110' produces a space within the pressure sensitive adhesive layer.

The outer layer 102 and pressure sensitive adhesive combination is fed through a dryer 118 to dry the adhesive and then into the second adhesive application station 108. In the second adhesive station 108, the surface of a second rotogravure cylinder 110" is engraved so as to provide a mirror image of the permanent adhesive portion of the film bag laminate. The second rotogravure cylinder 110" rotates within a pan 112" of permanent adhesive. As the outer layer 102 passes the second rotogravure cylinder 110", the permanent adhesive is applied to the outer layer 102 in register with the space left in the pressure sensitive adhesive portion. The outer layer 102 is then fed through a dryer 120 to dry the adhesive.

After the adhesive has sufficiently dried, an inner layer of material is brought into register with the outer layer and the combination is laminated in a conventional manner, such as with heat and pressure, to complete the film bag laminate 124.

Although the invention has been described and illustrated with respect to the exemplary embodiments thereof, it should be understood by those skilled in the art that the foregoing and various other changes, omissions and additions may be made therein and thereto, without departing from the spirit and scope of the present invention.

What is claimed is:

1. A bag laminate comprising:

an inner layer; and an outer layer having printed indicia formed thereon, the outer layer including a fixed portion and a removable sticker portion, the fixed portion being attached to the inner layer with a permanent adhesive, and the removable sticker portion being attached to the inner layer with a pressure sensitive adhesive.

2. The film bag laminate of claim 1 wherein a gap also separates at least part of the pressure sensitive adhesive on the removable portion from the permanent adhesive on the fixed portion.

3. The film bag laminate of claim 2 wherein the gap completely separates the pressure sensitive adhesive from the permanent adhesive.

4. The film bag laminate of claim 2 wherein the gap completely separates the removable sticker portion and the pressure sensitive adhesive portion from the fixed portion and the permanent adhesive portion.

5. The film bag laminate of claim 1 wherein the fixed portion and the removable sticker portion are substantially coplanar.

6. The film bag laminate of claim 1 wherein the outer layer is made from polypropylene material.

7. The film bag laminate of claim 6 wherein the polypropylene material has a thickness between about 0.5 mils and about 2 mils.

8. The film bag laminate of claim 1 wherein the inner layer is made from polyethylene material.

9. The film bag laminate of claim 8 wherein the polyethylene material has a thickness between about 1 mil and about 4 mils.

10. The film bag laminate of claim 1 wherein the permanent adhesive is a urethane based adhesive.

11. The film bag laminate of claim 10 wherein the permanent adhesive has a thickness between about 0.03 mils and about 0.2 mils.

12. The film bag laminate of claim 1 wherein the pressure sensitive adhesive is a water-based acrylic adhesive.

13. The film bag laminate of claim 12 wherein the pressure sensitive adhesive has a thickness between about 0.07 mils and about 0.25 mils.

14. A film bag laminate comprising:

an inner layer;

an outer layer having a fixed portion and a removable sticker portion; and an adhesive layer disposed between the outer layer and the inner layer the adhesive layer operative for adhesively attaching the outer layer to the inner layer, the adhesive layer including a pressure sensitive adhesive portion located between the inner layer and the removable sticker portion of the outer layer, and a permanent adhesive portion located between the inner layer and the fixed portion of the outer layer.

15. The film bag laminate of claim 14 wherein at least part of the pressure sensitive adhesive portion is separated from the permanent adhesive by a gap.

16. The film bag laminate of claim 15 wherein at least part of the removable sticker portion is separated from the fixed portion by a gap.

17. The film bag laminate of claim 15 wherein the gap completely separates the pressure sensitive adhesive from the permanent adhesive.

18. The film bag laminate of claim 15 wherein the gap completely separates the removable sticker portion and the pressure sensitive adhesive portion from the fixed portion and the permanent adhesive portion.

19. The film bag laminate of claim 14 wherein the fixed portion and the removable sticker portion are substantially coplanar.

20. The film bag laminate of claim 14 wherein the outer layer is made from polypropylene material.

21. The film bag laminate of claim 20 wherein the polypropylene material has a thickness between about 0.5 mils and about 2 mils.

22. The film bag laminate of claim 14 wherein the inner layer is made from polyethylene material.

23. The film bag laminate of claim 22 wherein the polyethylene material has a thickness between about 1 mil and about 4 mils.

24. The film bag laminate of claim 14 wherein the permanent adhesive is a urethane based adhesive.

25. The film bag laminate of claim 24 wherein the permanent adhesive has a thickness of between about 0.03 mils and about 0.2 mils.

26. The film bag laminate of claim 14 wherein the pressure sensitive adhesive is a water-based acrylic adhesive.

27. A bag laminate comprising:

an inner layer; and an outer layer having printed indicia formed thereon, the outer layer including a fixed portion and a removable decal portion, the fixed portion being attached to the inner layer with a permanent adhesive, and the removable decal portion having a thermally sensitive adhesive on the surface thereof facing the inner layer.

28. The film bag laminate of claim 26 wherein the pressure sensitive adhesive has a thickness of between about 0.07 mils and about 0.25 mils.

29. A bag laminate comprising:

a continuous inner layer; and an outer layer having printed indicia formed thereon, the outer layer including a fixed portion and a removable sticker portion, the fixed portion being attached to the inner layer with a permanent adhesive, and the removable sticker portion being attached to the inner layer with a pressure sensitive adhesive.

30. The bag laminate of claim 29 wherein a gap also separates at least part of the pressure sensitive adhesive on the removable portion from the permanent adhesive on the fixed portion.

31. The bag laminate of claim 30 wherein the gap completely separates the pressure sensitive adhesive from the permanent adhesive.

32. The bag laminate of claim 30 wherein the gap completely separates the removable sticker portion and the pressure sensitive adhesive portion from the fixed portion and the permanent adhesive portion.

33. The bag laminate of claim 29 wherein the fixed portion and the removable sticker portion are substantially coplanar.

* * * * *